US005939842A

United States Patent [19]

Beeteson et al.

[11] Patent Number: 5,939,842

[45] Date of Patent: Aug. 17, 1999

[54] SELF STABILIZING ELECTRON SOURCE FOR FLAT PANEL CRT DISPLAYS

[75] Inventors: John Beeteson, Skelmorlie; Andrew Ramsay Knox, Kilbirnie; Christopher Carlo Pietrzak, Gourock, all of United Kingdom

[73] Assignee: International Business Machines Corporation, Armonk, N.Y.

[21] Appl. No.: 08/907,070

[22] Filed: Aug. 6, 1997

[30] Foreign Application Priority Data

Feb. 24, 1997 [GB] United Kingdom ..... 9703807

[51] Int. Cl.[6] ..... G09G 1/04; H01J 29/70

[52] U.S. Cl. ..... 315/366; 315/169.3; 313/495

[58] Field of Search ..... 313/582, 431, 313/495, 496, 497, 426–427, 421, 422, 409, 410–417, 302; 315/169.1, 160, 161–168, 169.3, 366

[56] References Cited

U.S. PATENT DOCUMENTS

| | | | |
|---|---|---|---|
| 3,935,500 | 1/1976 | Oess et al. | 313/495 |
| 5,272,419 | 12/1993 | Park | 315/169 |
| 5,597,518 | 1/1997 | Lovoi | 264/1.21 |
| 5,760,548 | 6/1998 | Beeteson et al. | 315/366 |

FOREIGN PATENT DOCUMENTS

| | | | |
|---|---|---|---|
| 0213839 | 8/1986 | European Pat. Off. | H01J 31/12 |
| 0213839 A2 | 3/1987 | European Pat. Off. . | |
| 1312906 | 11/1971 | United Kingdom | H01J 3/00 |

OTHER PUBLICATIONS

XS 983006310 MA, Abstract / Zusammenfassung / Abrege.

D.A. Wright, *"A survey of the present knowledge of thermionic emitters"*, Proc. IRE, 1952.

K.R. Spangenberg, *"Vacuum Tubes"*, McGraw–Hill, 1948. pp. 168–200 and pp. 248–265.

G.H. Metson, *"On the electrical life of an oxide cathode receiving tube"*, pp. 403–445.

F.G. Oess, *"The uniform remote virtual cathode system"*, SID Digest 1994.

IBM Technical Disclosure Bulletin vol. 29, No. 9, Feb. 1987, p. 400.

*Primary Examiner*—David H. Vu

*Attorney, Agent, or Firm*—George E. Grosser

[57] ABSTRACT

A virtual remote cathode has the position of a space charge cloud associated with it fixed by the geometry of a fixed insulating plate. The plate can be made to accurate dimensions and hence the cathode to control grid dimension can be accurately controlled and will not change as a result of any mechanical, electrical or physical changes in the construction. The fixed insulating plate is located on a surface of the control grid facing the cathode.

6 Claims, 5 Drawing Sheets

SELF STABILIZING ELECTRON SOURCE FOR FLAT PANEL CRT DISPLAYS

FIELD OF THE INVENTION

The present invention relates to matrix addressed electron beam displays and particularly to a self stabilizing cathode for use in matrix addressed electron beam displays.

BACKGROUND OF THE INVENTION

Flat panel electron beam displays comprise a cathode and an anode contained in an evacuated envelope. In operation, the cathode is held at a negative potential relative to the anode. Electrons are emitted from the cathode. The potential difference between the cathode and the anode accelerates the emitted electrons from the cathode towards the anode. The emitted electrons are formed, within the display, into electron beams. A beam current thus flows between the anode and the cathode. In flat panel electron beam displays a matrix arrangement is disposed between the cathode and the anode. The matrix arrangement is formed by a pair of "combs" placed at right angles to each other. These are commonly referred to as rows and columns. Each pixel or subpixel lies at the intersection of a row and a column. Each of the combs has many separate elements (rows or columns). In operation, a control voltage is applied to each element of each of the combs. The control voltage applied to each element imposes an electrostatic force on the electron beam associated with that element. The electron beam current associated with that element can be adjusted by adjusting the control voltage.

Matrix driven flat CRT displays require the use of an area cathode to provide a uniform source of electrons to each pixel aperture. Field emission electron sources such as Metal-Insulator-Metal (MIM), Printable Field Emitter (PFE) and Field Emission Devices (FED) do not require heating, but are non space charge limited and suffer from problems of uniformity and instability that require some form of smoothing to make their use practical.

Thermionic cathodes are excellent sources of electrons. Thermionic remote virtual cathodes are known in the prior art. They form a uniform planar space charge cloud remote from the hot filaments, but these have problems of sensitivity to constructional tolerances, to ageing of the oxide cathodes and to voltage variations on control grids.

SUMMARY OF THE INVENTION

In accordance with the present invention, there is now provided an electron source comprising cathode means, a collimation block and control grid means wherein the control grid means controls a flow of electrons from the cathode means to the collimation block and the collimation block forms electrons received from the cathode means into one or more electron beams for guidance towards a target, the collimation block having an insulated plate located on a side facing the cathode means, the surface of the flat insulated plate facing the cathode being at a predetermined distance from the control grid and being perforated with one or more apertures for each of the one or more electron beams.

The use of a self charged insulating plate provides a thermionic remote virtual cathode which is self stabilising. This offers the ability to minimise constructional tolerance sensitivity and to eliminate sensitivity to control grid voltage variations and cathode ageing.

An isolated, conducting layer is preferably coated on the surface of the insulated plate facing the cathode. In a preferred embodiment, the conducting layer may be connected to a controlled leakage resistance. A voltage measuring device may be connected to the conducting layer.

Preferably, the cathode means comprises a thermionic emission device and the collimation block comprises a magnet.

The invention also provides a display device comprising: an electron source as described above; a screen for receiving electrons from the electron source, the screen having a phosphor coating facing the side of the collimation block remote from the cathode; and means for supplying control signals to the control grid means and the anode means to selectively control flow of electrons from the cathode to the phosphor coating via the channels thereby to produce an image on the screen.

Also provided by the invention is a computer system comprising: memory means; data transfer means for transferring data to and from the memory means; processor means for processing data stored in the memory means; and a display device as described above for displaying data processed by the processor means.

BRIEF DESCRIPTION OF THE DRAWINGS

Preferred embodiments of the present invention will now be described, by way of example only, with reference to the accompanying drawings in which.

DETAILED DESCRIPTION OF THE PREFERRED EMBODIMENTS

Figure 1:
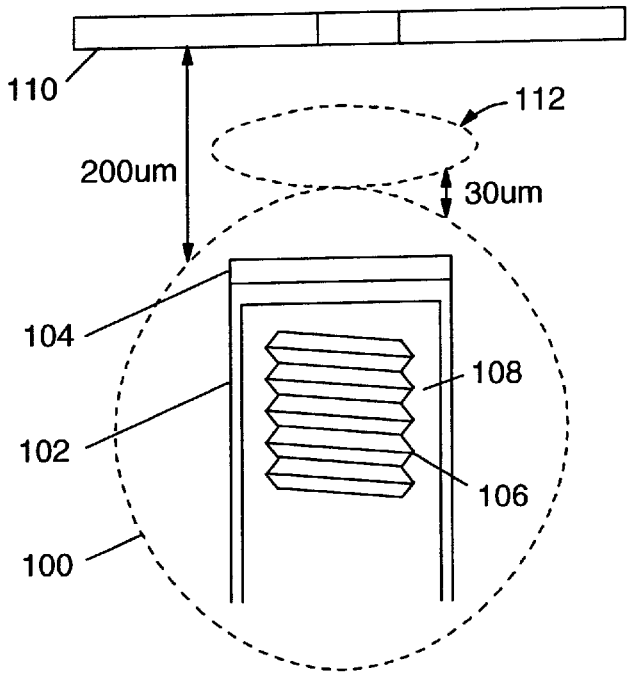
FIG. 1 (PRIOR ART)
FIG. 1 is a diagram of a typical prior art indirectly heated thermionic cathode of the type used in CRTs.

FIG. 1 shows a typical indirectly heated thermionic cathode 100 of the type used in conventional CRTs. A metal sleeve 102, typically Nickel, is held at zero volts and indirectly heated by a heater 106 so that the 100 $\mu$m thick oxide coating 104 reaches about 750° C. An electrical insulator 108 is present between the heater 106 and the metal sleeve 102. The oxide coating 104 typically consists of a mixture of the oxides of Barium, Strontium and Calcium, and at temperatures high enough for the thermal energy of the electrons to exceed the surface work function (typically 1.5 eV) emits copious quantities of electrons. The cathode assembly is typically positioned 200 $\mu$m from a control electrode or Grid 1 (110). The electrons form a space charge electron cloud 112 positioned about 30 $\mu$m from the oxide 104 of the metal sleeve 102. Further details of a cathode of the type shown in FIG. 1 can be found in D A Wright, "A survey of the present knowledge of thermionic emitters", Proc IRE, 1952, pp.125–142.

Figure 2:
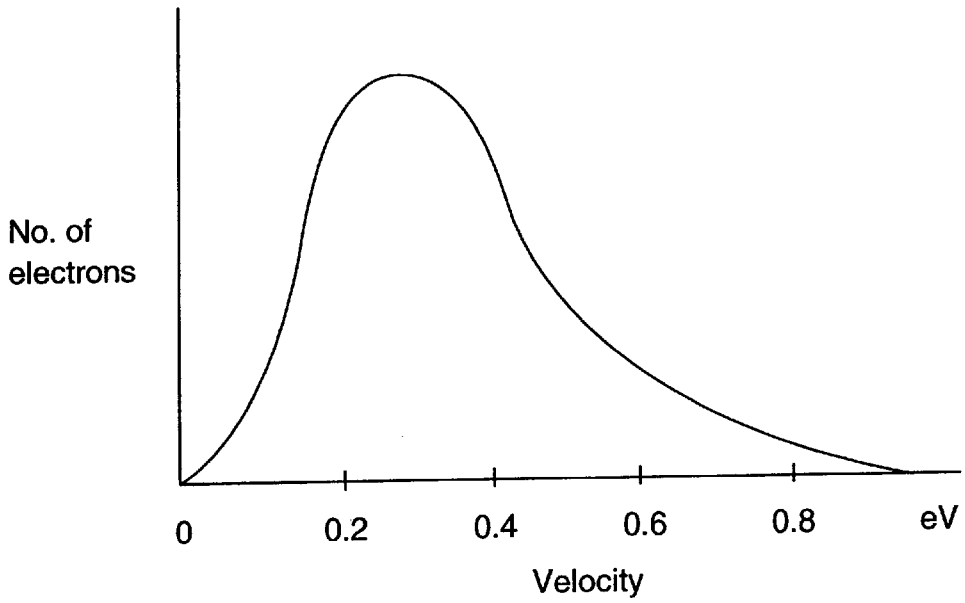
FIG. 2 (PRIOR ART)
FIG. 2 is a graph of the velocity distribution of electrons emitted from the cathode of FIG. 1.

FIG. 2 shows a graph of the velocity distribution of electrons emitted from the thermionic cathode of FIG. 1. The electrons are emitted with a Maxwellian velocity distribution. In this thermionic cathode, 90% of electrons are emitted with velocities below 0.5 eV.

Space Charge

Of great importance in the operation of the cathode of FIG. 1 is the space charge effect due to the intrinsic charge of the emitted electrons. At the normal operating temperature of the cathode, the number of electrons produced is so large that the local potential is significantly depressed, and hence the effective field at the cathode is reduced. Cathodes are normally operated in a space charge limited mode, in which the emission temperature is sufficient to produce a potential minimum a short distance from the cathode, hence masking local emission variations from the physical cathode surface. Electrons are drawn from a "virtual cathode", which is located at this potential minimum.

Figure 3:
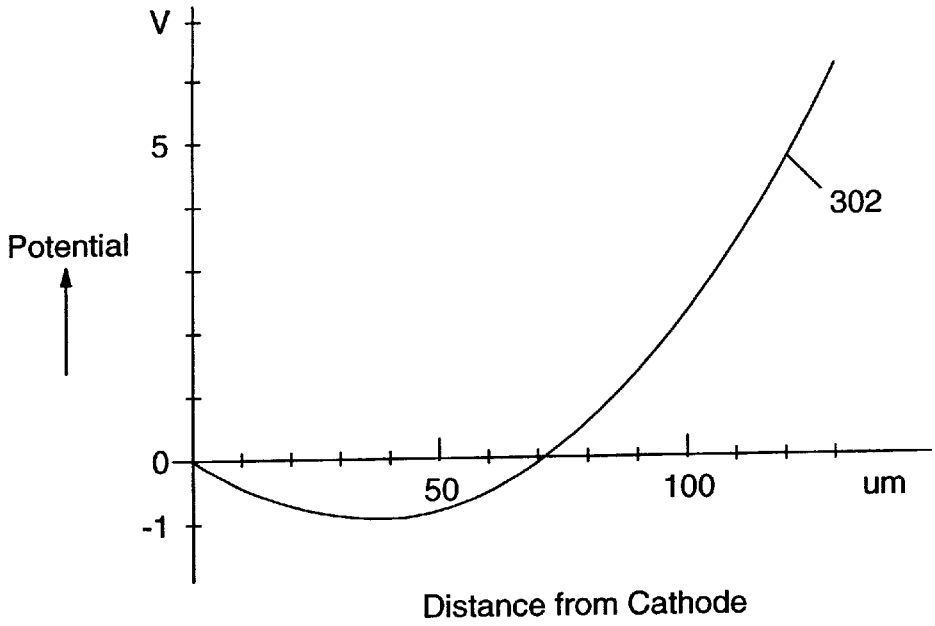
FIG. 3 (PRIOR ART)
FIG. 3 is a graph of the potential versus distance from the cathode of a typical structure, such as that of FIG. 1.

FIG. 3 illustrates the effect with a curve from a diode simulation. Line 302 shows the local potential at varying distance from the outer surface of the oxide coating 104 of the cathode 100. The space charge produces a retarding field at the cathode, and only those electrons emitted with sufficient energy to allow them to overcome the potential minimum can now reach the anode. Further discussion of the effects of space charge can be found in K R Spangenberg, "Vacuum Tubes", McGraw-Hill, 1948, pp.168–200. A further increase in cathode temperature above that needed to produce a potential minimum a short distance from the cathode increases the space charge density and further depresses the potential until it is just sufficient to limit the current to its previous value. Thus the electron current flowing is no longer a function of the emission capability of the cathode, but becomes dependant on the anode voltage and the geometry only. The device is said to be operating in a "space charge" limited condition. The effect is such that electrons appear to be produced at low velocity from a point in space just in front of the cathode; this is referred to as the "virtual cathode".

In FIG. 1, the space charge cloud 112 at the potential minimum—the virtual cathode—is shown, with dimensions typical of a colour CRT. It should be appreciated that the electrons emitted from the virtual cathode 112 will have thermal velocities taken from only a portion of the spread of thermal velocities of electrons emitted from the cathode surface; in fact only the highest velocity electrons will be extracted, and these will have had their velocity reduced to close to zero. This is because the beam current extracted from the virtual cathode is deliberately chosen to be only a small fraction of the total emission electrons. Those electrons not taken away from the virtual cathode in beam current drop back to the cathode, to be replaced in an endless cycle by further thermal electrons. In a typical CRT, only perhaps 2% of the electrons are extracted as beam current at the start of life of the CRT. As a cathode ages, its ability to emit electrons diminishes, and so the effective emission constant drops. This has the effect of reducing the magnitude of the potential minimum (because the electron and hence the space charge density drops) and hence if the beam current is kept constant then the percentage extracted rises and so does the thermal velocity spread (measured in eV) of the extracted electrons.

Figure 4:
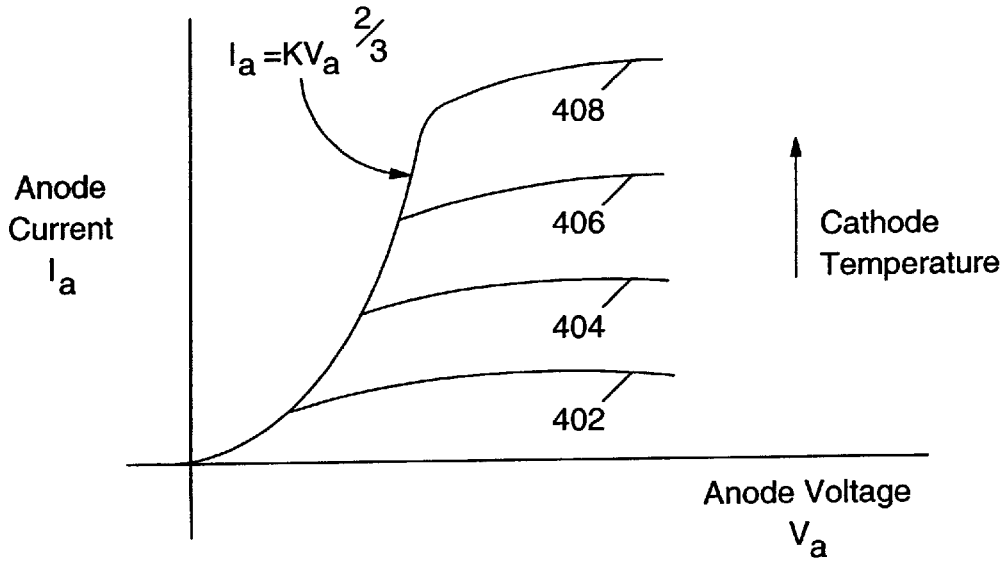
FIG. 4 (PRIOR ART)
FIG. 4 is a graph of the VI characteristic of a prior art vacuum diode.

FIG. 4 shows the anode voltage ($V_a$) versus current ($I_a$) characteristic of a vacuum diode. The four lines 402–408 shown are for different cathode temperatures, the maximum anode current increasing as the cathode temperature increases.

In the space charge limited region the current may be approximately calculated (in one dimension) by the Child-Langmuir law:

$$I_a = KV_a^{\frac{3}{2}}$$

where $$K = \frac{4\epsilon_0 A}{9d^2}\sqrt{\frac{2e}{m}}$$

and $\epsilon_0$ is the permittivity of free space, A is the emission area, d is the distance from the virtual cathode to the anode, e is the charge on an electron and m is the mass of the electron.

Similarly the current density (J):

$$J = \frac{4\epsilon_0}{9d^2}\sqrt{\frac{2e}{m}}\,V_a^{\frac{3}{2}}$$

Note that this equation assumes that electron emission from the cathode is unlimited; as the fraction of beam current extracted increases, or as emission reduces with age, so deviations occur from the three halves power law, and this is the prime effect coming from CRT cathode ageing. This effect is described further in G H Metson, "On the electrical life of an oxide cathode receiving tube", p.408.

Remote Virtual Cathodes

Figure 5:
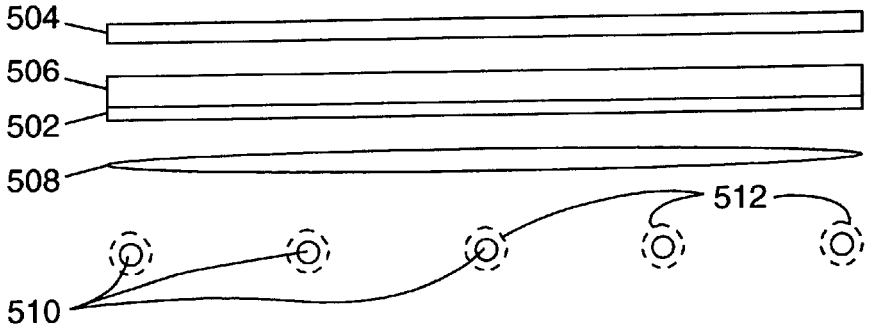
FIG. 5 (PRIOR ART)
FIG. 5 is a section through a prior art flat screen CRT having a remote virtual cathode.

FIG. 5 shows a flat screen CRT with cathode filaments 510 and associated local virtual cathodes 512. Also shown in FIG. 5 are control grids 502, a collimation block 506 and a phosphor screen 504. In the flat CRT of FIG. 5, it is required to place a flat plane or volume of electrons just under the matrix control grids 502. Hot oxide coated filaments 510 create local virtual cathodes 512 under space charge limited conditions as described previously. Another virtual cathode 508 needs to be created as a composite of all the local ones 512, but remote from the hot filaments 510 at a predetermined distance from the control grids 502. This virtual cathode 508 will be called the "Remote Virtual Cathode". A second requirement is to make the remote virtual cathode 508 of uniform electron density and at a fixed distance from the control grids 502 (because it is this distance which becomes the cathode to grid spacing in the matrix electron guns of the flat CRT).

Figure 10:
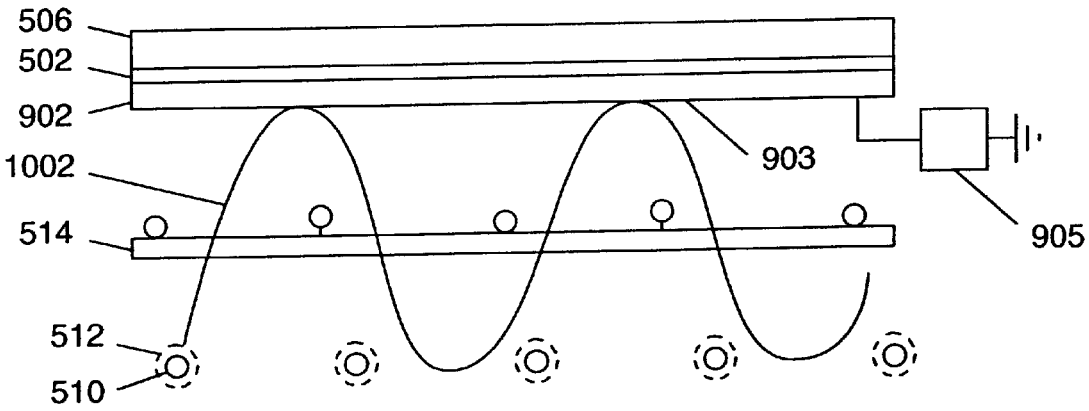
FIG. 10 is a cross-section through a cathode according to the present invention, shown in an equilibrium state.

Remote virtual cathodes were developed in the 1930 timeframe for use in beam power valves. This is described in K R Spangenberg, "Vacuum Tubes", McGraw-Hill, 1948, pp 248–265. FIG. 10.12 on p 262 of this reference gives a diagram of the grids of such a valve, with the field potentials. The construction is a tetrode arrangement, with the potentials and geometries of the grids arranged so as to create a potential minimum between the screen grid and the anode by slowing the electrons and so increasing the electron density. A basic requirement in order to create such a characteristic was to produce a very nearly parallel flow of electrons, and hence the electron density at the remote virtual cathode was also very uniform. There is, of course, no matrix of control grids as the anode target, but it is only this factor that distinguishes the topology of remote virtual cathodes subsequently designed for flat CRTs from the beam power tetrode. In summary, if an extractor grid is arranged to produce a nearly parallel flow of electrons from a cathode, and if the voltages on the grids are correctly chosen, then a remote virtual cathode with a uniform volume of electrons at a uniform potential in a dense space charge limited cloud will be formed.

Figure 6:
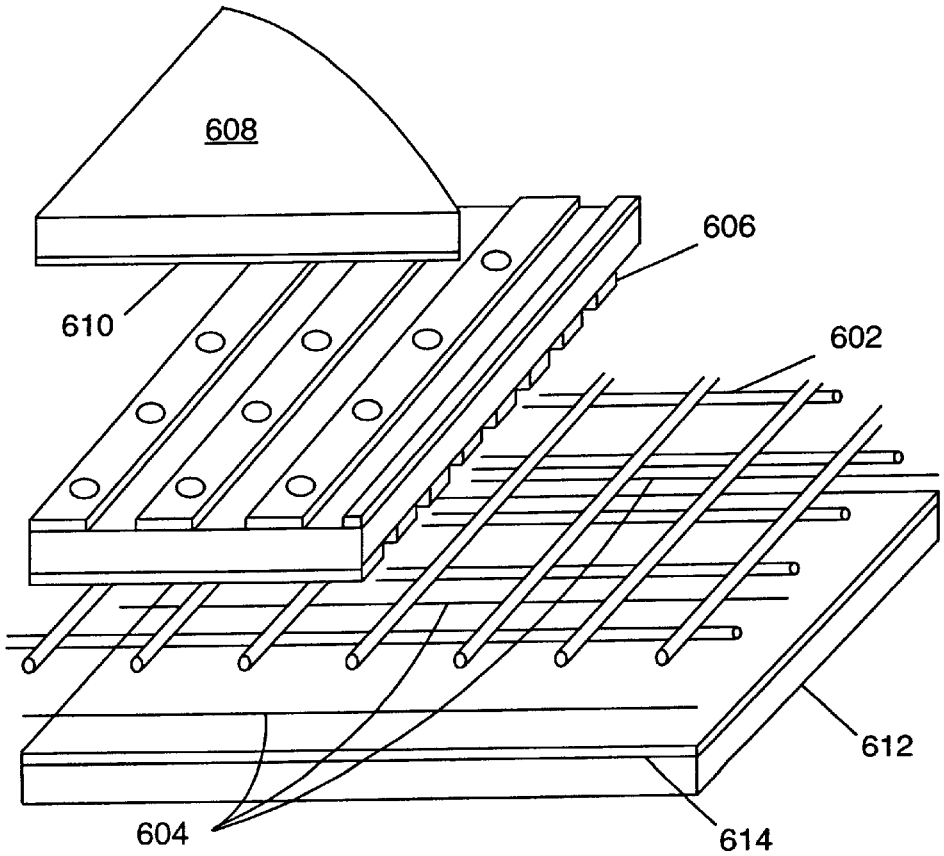
FIG. 6 (PRIOR ART)
FIG. 6 is a view of a prior art remote virtual cathode designed specifically for flat matrix driven CRTs.

An example of a remote virtual cathode designed specifically for flat matrix driven CRTs from Source Technology Corporation can be found in EP A2 0 213 839 and F G Oess, "The uniform remote virtual cathode system", SID Digest 1994. The Source Technology cathode is illustrated in FIG. 6 of the present application, taken from FIG. 2 of EP A2 0 213 839. A further example of a remote virtual cathode designed specifically for flat matrix driven CRTS from Samsung can be found in U.S. Pat. No. 5,272,419.

FIG. 6 shows a partially broken away, exploded, perspective view of a flat CRT. The flat CRT has a glass screen 608 having a phosphor coating 610. The extraction grid 602 creates a uniform flow of electrons from the local virtual cathodes of the hot wire oxide coated filaments 604. A glass substrate 612 is located at the rear of the hot wire oxide coated filaments 604 and has a deflector backing 614. The control grids 606 are arranged to be at, or slightly lower than, the cathode voltage (identical to the screen/anode grid potential arrangement in the beam power valve), so that the electrons are slowed and then reversed near the control grids 606. This slowing causes an increase in the electron density (at 702 in FIG. 7) and hence a remote virtual cathode and a potential minimum.

Figure 7:
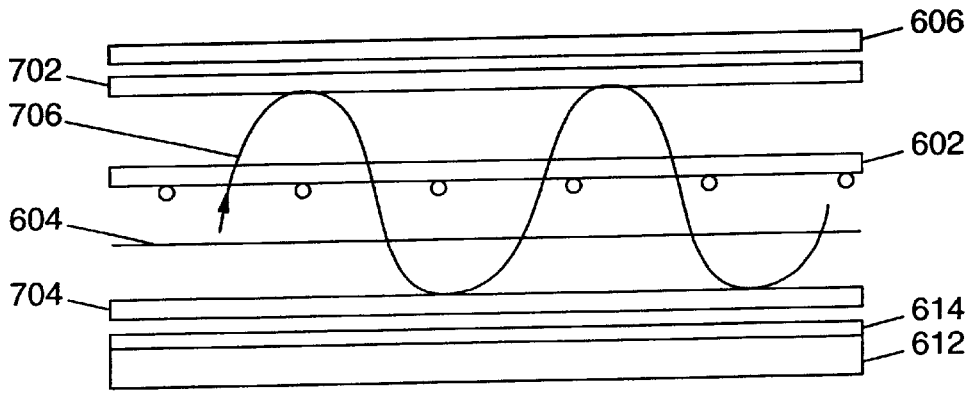
FIG. 7 (PRIOR ART)
FIG. 7 is a cross-section of the cathode of FIG. 6 showing the path of one electron.

If the extraction grid 602 has a high enough transmission then most electrons will reach this point, and will then be reflected back and forward until absorbed by the extractor grid 602. The increase in the electron density caused by the slowing of the electrons is shown in FIG. 7 as the bands of electrons 702 near the control grids and 704 near the deflector backing. The path 706 of a typical electron is shown. In operation in a CRT, the control grids 606 will be taken slightly positive at a pixel which is switched on, and hence current will be extracted from the remote virtual cathode and directed towards the phosphor screen 610. This cathode has been demonstrated in operation in a prototype flat CRT by Source Technology.

The Source Technology remote virtual cathode, therefore, is a direct application of the early beam power valve topologies to a flat CRT. The equations of electron flow will be governed by the Child-Langmuir law and, neglecting the constant losses in the extractor grid 602 and the current extracted by "on" pixels, the current density on the filament 604 side of the extractor grid 602 must be the same as on the control grid 606 side. Non uniformity in current density caused by, for example, grid structure mechanical tolerances, or control grid voltage variations, will be averaged out in the space charge flow, since any local variation in the potential distribution in the space charge cloud will cause electrons to redistribute themselves in space to cancel the effect.

Although variations in spacings or voltages will not cause a change in the remote cathode uniformity (at least to a first order), they will cause a change in the position of the remote virtual cathode relative to the control grids, and this is an important parameter in the CRT electron gun equation affecting the beam current modulation and hence screen brightness. Voltages can be precisely regulated, but mechanical tolerances are less easily controlled, and electrode spacing changes are bound to occur as the cathode filaments heat up to their operating temperature of about 750° C.

Figure 8:
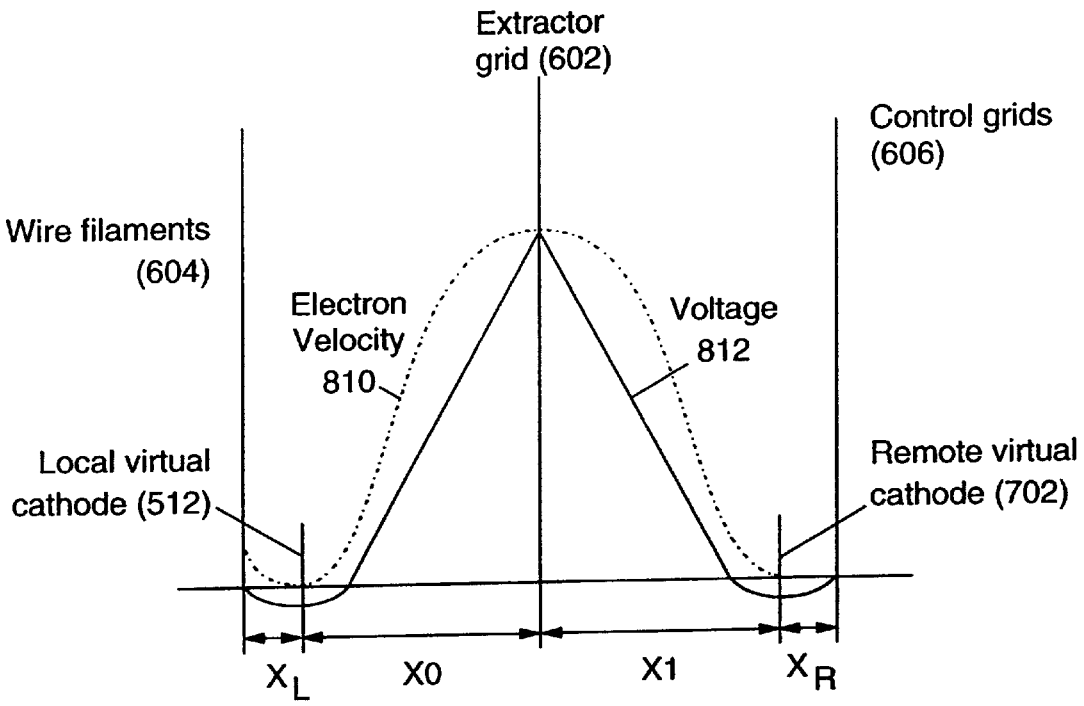
FIG. 8 (PRIOR ART)
FIG. 8 is a graph of the potential distributions and electron velocities of the cathode of FIG. 7.

For example, consider a design with a filament 604 to extractor grid 602 and an extractor grid 602 to control grid 606 spacing, each of 1 mm, and an extractor grid voltage of 10 V. The potential distributions and electron velocities are illustrated in FIG. 8. The wire filaments 604 for the cathode are located at the left hand side of FIG. 8. The control grids 606 are located at the right hand side of FIG. 8. Shown at the centre of FIG. 8 is the peak electron potential and the peak electron velocity, which is at the extractor grid 602 location. The distance between the wire filaments (604 in FIG. 6) and the potential minimum corresponding to the local remote cathode is shown as $x_L$, the distance between this potential minimum and the potential maximum (802) at the extractor grid is shown as $x_0$. The distance between the control grids (502 in FIG. 5) and the potential minimum corresponding to the remote virtual cathode (508 in FIG. 5) is shown as $X_R$, the distance between this potential minimum and the potential maximum at 602 is shown as $x_1$. The electron velocity is shown by the line labelled 810 and the voltage is shown by the line labelled 812. $V_{xL}$ is the voltage at the potential minimum at the local virtual cathode 512. $V_{acc}$ is the potential at the potential maximum which is located at the extractor grid 602.

On the input side, that is from the wire filaments 604 to the potential maximum at 602:

$$J = \frac{K \cdot (V_{acc} - V_{xL})^{\frac{3}{2}}}{x_0^2}$$

If $V_{x1}$=−1.5 V, $V_{acc}$=10 V, $x_0$=1 mm, then the current density, J=38.9984 K.

To a first order, J on the output side must be the same, neglecting transmission losses in the extractor grid 602. The density of electrons is determined by the number of electrons (set by J) and the volume of space which they occupy. Hence the density of electrons on the output side will be determined by the spacing of the extractor grid to the control grids. This assumes that the control grids are at 0 volts. Space charge due to the electron density will cause a reduction in local voltage and therefore the slope of the voltage curve on the output side will be determined by this spacing. However, the peak negative value of the remote virtual cathode voltage cannot change (electrons at both the local and remote cathodes are at zero electron volts potential). The overall result is that the position of the remote virtual cathode moves towards the extractor grid and broadens in width.

It should also be apparent that variations in the control grid 606 voltage will affect $x_R$; making the voltage more negative will push the remote virtual cathode 508 back towards the extraction grid (602 in FIG. 6).

A further parameter affecting the position of the remote virtual cathode 508 is the effect of cathode 510 ageing. This causes the emission constant to reduce, and hence the total number of electrons emitted reduces. In addition, as cathodes 510 age, material (in particular Barium) is evaporated, and the cathode 510 to control grid 502 distance increases. The result of these two effects in a remote virtual cathode system is to increase the cathode 510 to extractor grid (602 in FIG. 6) distance (i.e. $x_0$) and to broaden the width of the local virtual cathode 512 space charge cloud. At the remote virtual cathode position this will be seen as a movement of the virtual cathode plane away from the control grids.

A prior art remote virtual cathode as described above is not self-stabilizing. It is subject to considerable constructional tolerance sensitivity and to control grid voltage variations. It is also subject to cathode ageing changing the characteristics.

A Self Stabilising Virtual Cathode Configuration

In the basic remote virtual cathode topology, the position of the remote virtual cathode space charge cloud is not fixed; it is at a variable distance, $X_R$, from the control grids. Because the position is not fixed it becomes susceptible to mechanical and cathode tolerances as previously described.

In a preferred embodiment, the collimation block is a permanent magnet perforated by a plurality of channels extending between opposite poles of the magnet wherein each channel forms electrons received from the cathode means into an electron beam for guidance towards a target. However, other types of collimation blocks may be used, such as the conventional types of electrostatic collimation block well known in the art.

Figure 9:
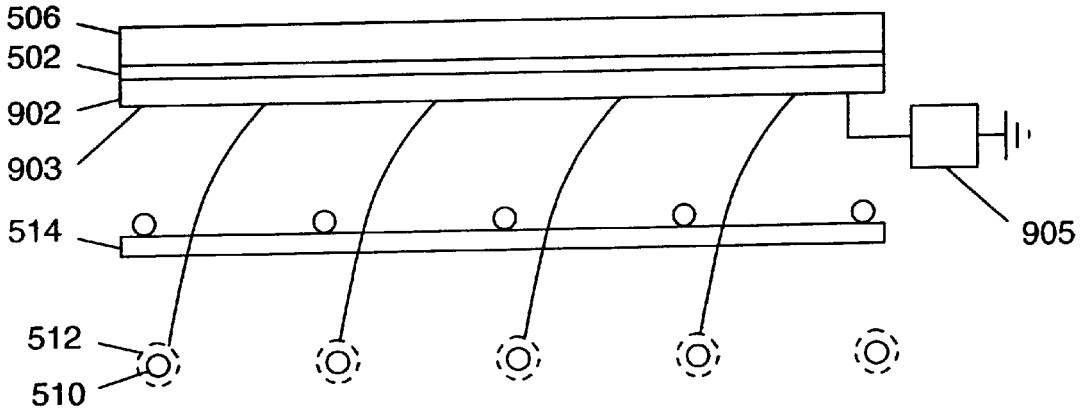
FIG. 9 is a cross-section through a cathode according to the present invention, shown when first powered on and with no picture displayed.

In the present invention, illustrated in FIGS. 9 and 10, an insulating plate 902 is placed at a fixed distance from the control grids 502. The insulating plate 902 is perforated with an aperture per pixel. Preferably this is simply a ceramic plate attached directly on the underside of a magnet used for the collimation block 506. The collimation block is typically 1 to 5 mm thick, the grids are of the order of a few $\mu$m and the insulator is typically less than 50 $\mu$m thick. Since the cathode 510 plane is typically 100–200 $\mu$m from the control grids 502, it is easy to make this to very high accuracy, particularly over short lateral distances, as is the requirement in a display. The filaments 510 and extractor grid 514 are conventionally placed.

When power is first applied to the display (at start up), it is necessary that the plate 902 be in a field sufficiently positive to ensure that all electrons strike the insulating plate 902, that is the field at the plate must be more positive than the local virtual cathode 512. Since the field at the virtual cathode is negative, then a voltage of zero volts at the insulating plate is suitable. Control elements later in the display, such as the first anode, can be used to ensure that there is no picture on the screen during the few seconds necessary for heater warm up and cathode stabilisation as is well known in the art of CRT design and manufacture. FIG. 9 shows the conditions when power is first applied to the cathode and the control grids 502 are set to a positive voltage to attract electrons. Electrons are emitted from the cathode 510 filaments and pass through the extraction grid 514 towards the control grid 502.

As time goes on, electrons will be attracted to the insulating plate 902 and gradually build up a surface charge. The charge density created on the surface of the insulating plate 902 will give rise to a surface potential, and this must reach an equilibrium condition in which a negative value of surface potential is achieved that eventually just turns back all electrons towards the extraction grid. This is now an equilibrium for static conditions and is shown in FIG. 10. The path of a typical electron is shown in FIG. 10 identified by the reference numeral 1002. After the operating conditions have stabilized, the control grids must be taken to their normal operating voltages.

We now have a self stabilised virtual remote cathode operating with electron paths which are the same as in the conventional arrangement, but with the virtual remote cathode plane precisely fixed by the geometry of the insulating plate, since the underside of the plate is the point of grazing incidence to the most forward position of the space charge cloud. Whatever happens to geometries, voltages and cathode ageing in the rest of the cathode, this point will always be fixed if conditions remain static.

Dynamic Conditions

The simple scheme outlined above has some problems when dynamic conditions are considered. First, when the control grids are switched from zero volts after start up to their normal operating negative voltage of about −3 V, the capacitive pulse this generates will be transferred to the charged side of the insulating plate and hence the remote virtual cathode electrons will move away from the plate.

When voltages on the control grids 502 are switched during operation, the capacitance between the grids (primarily grid 1) and the electron charge on the base of the insulating plate 902 may cause the attraction of further electrons if there is any imbalance between one grid switching positive and the next switching negative. This will change the local voltage set up on the insulating plate 902. Also, if charge leakage from the insulating plate 902 is low (as would be expected), then any dynamic change in the cathode 510 (e.g. a change in the position of the extractor grid 514) requiring that there be less charge on the insulating plate 902 would not be acted on immediately. Further, there is the possibility that local charge accumulation on the insulating plate 902 will not be uniform, resulting in a non uniform virtual cathode 510 to insulating plate 902 distance.

In a preferred embodiment, these effects can be corrected by various critical changes described below.

The underside of the insulating plate 902 can be coated with a conducting surface 903, such as a deposition of a thin metal layer (by sputtering, evaporation or electroless plating) so that local charge changes are prevented, and the surface of the insulating plate will always have a uniform potential. Note that this layer can be made highly reflective so as to reflect the infra red radiation from the cathodes 510 back onto a blackened absorbing rear surface so as to minimise the heating of the collimation block, which in the case of the preferred embodiment is a magnet.

The metal layer can be connected via a high resistance path 905 to ground, so that charge can leak away in a controlled manner and allow the insulating plate 902 voltage to respond to reductions as well as increases in electron accumulation. Note that this resistance path would be a high value (in the order of hundreds of MegOhms), so that charge accumulation is still effective. The dynamic changes such as extractor grid 514 position movements due to thermal warm up are long time constants (for example the thermal expansion of gun elements due to heater power in a conventional CRT takes on the order of 20 minutes) so that a high leakage resistance is appropriate. There will be a constant current taken from the electron source with this resistance in place, but it will be very small.

Start up of the electron source can be simplified by the presence of a conducting layer on the surface of the insulating layer facing away from the control grids. The conducting layer is connected, via a high resistance connection, or via an initial charging circuit, to a voltage more positive than the local virtual cathode. Zero volts is suitable, as the local virtual cathode is at a negative voltage, but a fixed positive voltage is advantageous and the high resistance connection could be taken to this point. The extractor grid voltage is a suitable fixed positive voltage. As electrons hit the conducting layer, charge accumulation will cause a uniform potential to build up as previously described until a stable condition is achieved with all electrons turning back just before striking the conducting plate, and with a conducting plate voltage approximately the same value as the local virtual cathode. The control electrodes located on the collimating block can remain at their normal operating levels with this configuration.

A step by step description of the start up and operation of an electron source with a conducting layer on the insulating plate connected via a high resistance will now be given.

Startup

Step 1—The cathode filament is at zero volts and is cold. The control grids all have no potential applied.

Step 2—The cathode has power applied. The extraction grid is taken to about +10 volts in order for it to operate. The conducting layer is taken positive by either an initialising circuit or allowed to rise positive by an RC time constant.

Step 3—The conducting layer stabilises at a positive voltage.

Step 4—The cathode filament warms up. Initially, the cathode will be in a thermal saturation mode and all electrons are accelerated towards the extractor grid. Most electrons continue past the extractor grid and begin decelerating (at a rate dependent on the positive voltage set on the conducting layer). Electrons strike the conducting layer, and the layer potential begins to fall. Some current will flow through the high resistance connection, but not sufficient to remove all the electrons from the layer.

Step 5—The cathode reaches operating temperature and becomes space charge limited. The conducting layer potential continues to fall until it becomes approximately the same as the local virtual cathode (typically −0.2 V). Because there is a small current flowing through the high resistance connection, some electrons continue to strike the layer, and hence the layer voltage will be a few mV more positive than the local virtual cathode.

Operation

Step 6—Electrons which have a potential of nearly 0 eV are accelerated away from the local virtual cathode space charge cloud by the extractor grid. Electrons which miss the extractor grid wires (around 95% of the electrons) slow down as they approach the conducting layer on the insulated plate, reach a potential of 0 eV just at the layer surface, stop and then reverse direction back towards the extractor grid. Electrons which miss the extractor grid wires (around 95% of the electrons) continue until they are slowed, stopped and reversed near the cathode filament wires. This cycle continuously repeats, although the number of cycles is limited by the transmission of the extractor grid.

Cathode Ageing

A further problem is that of cathode ageing. In an area cathode according to the present invention there will be no change in the mean position of the remote cathode, but the potential of the insulating plate 902 and the width of the space charge cloud will change. This is not an extra problem, as the equivalent effect occurs in the prior art designs, but the new design allows this to be controlled.

The potential on the underside of the insulated plate 902 is a function of the following parameters:

$$V_{plate}=F(V_{filament}, Temp_{filament}, Pos_{accgrid})$$

where $V_{plate}$ is the voltage on the insulating plate, $V_{filament}$ and $Temp_{filment}$ are the filament voltage and temperature respective and $Pos_{accgrid}$ is the position of the extractor grid.

Because we have access to $V_{plate}$ we have the possibility to use this in a feedback arrangement to stabilise $V_{plate}$. In fact this potential will always be slightly negative with respect to the filament voltage because it must be sufficient to deflect all but the highest eV electrons extracted from the local virtual cathode 512. It will usually be most convenient to have the plate at zero potential (to make the driver circuits easier to design), and so a slight positive voltage on the cathode filament wires would be an advantage.

The filament voltage $V_{filament}$ can be used to stabilize the plate voltage, but an additional way is to control the filament temperature $Temp_{filament}$. This has been proposed before (using data from actual CRT life tests under different cathode temperature conditions) in conventional CRTs (see IBM Technical Disclosure Bulletin Vol. 29, No. 9 Feb 1987, p.3896) as a counter to cathode ageing, but it is more difficult because special arrangements have to be made to measure beam current. With plate voltage available, measurement becomes very easy (simply a high impedance electrometer circuit, which also acts as the controlled leakage path 905), and the voltage is fed back via the simplest first order servo circuit to control the heater power and hence the filament temperature. Time constants in such a servo are long—several minutes—so that stability is not an issue. In fact, in a further preferred embodiment, both filament voltage and heater power together are used as the control, with an appropriate percentage of each determined by experiment. The objective to be achieved by the experimentation is beam current stability and hence brightness stability.

To understand how heater power can affect the conditions, it should be appreciated that the three halves space charge limited power law is only accurate if the emission current from the cathode filament is unlimited. When the emission current is limited (and this drops with cathode ageing), the percentage of current that is extracted from the local virtual cathode becomes important. K R Spangenberg, "Vacuum Tubes", McGraw-Hill, 1948, on pages 192–193 gives the following formulae for the position and value of the local virtual cathode potential minimum in an oxide cathode system:

$$x_L = \frac{(x_L + x_0)}{1 + \left(\frac{V_{acc}}{V_{x_L}} + 1\right)^{\frac{3}{4}} \left(\frac{2}{p} - 1\right)^{\frac{1}{2}}}$$

and $$V_{x_L} = \left(\frac{T}{5040}\right) \log_{10}\left[\frac{1}{P}\right]$$

Where T is the emitter temperature in °K and P is the fraction of current extracted. In fact there is also an effect of temperature on $x_L$ apart from the $V_{xL}$ factor in a more exact solution. Note that $(x_L+x_0)$ is in fact a fixed geometric distance between the wire filaments 604 and the extractor grid 602.

The emission from a thermionic cathode is given in D A Wright, "A survey of the present knowledge of thermionic emitters", Proc IRE, 1952, pp.125–142 as:

$$J = A_0 \cdot T^2 \cdot e^{-\frac{\phi}{kT}}$$

Where J is the current density in $A/cm^2$, $A_0$ is a constant (typically about 70 $A/cm^2$-$deg^2$ for an oxide cathode at start of life), $\phi$ is the material work function (typically 1.5 eV for an oxide cathode at 1000° K) and k is Boltzmann's constant in eV ($8.6\times10^{-5}$).

Increasing T increases the emission current density (and also, to a small degree the velocity spread) of the cathode, and increasing the emission current density reduces the P fraction. The emission current density is very sensitive to temperature. In the above equation an increase of 37° K will double the value of J, so heater power can easily be used to compensate for a reduction in $A_0$ over life.

The area cathode of the present invention provides the advantages that the position of the virtual remote cathode space charge cloud is fixed by the geometry of a fixed insulating plate which can be made to accurate dimensions. The position will not change as a result of any mechanical, electrical or physical changes in the construction other than the plate. The electron charge potential built up on the under side of the plate will isolate the cathode from fixed values of the control grids, apart from the desired requirement of control grid extraction voltages pushing through the plate apertures. The voltage on the plate can be measured and used to eliminate the effects of geometry changes on the plate voltage, and the effects of cathode ageing.

We claim:

1. An electron source comprising:

cathode means, a collimation block and control grid wherein the control grid means controls a flow of electrons from the cathode means to the collimation block and the collimation block forms electrons received from the cathode means into one or more electron beams for guidance towards a target, the collimation block having an insulated plate located on a surface facing the cathode means, the surface of the insulated plate facing the cathode, being at a predetermined distance from the control grid and being perforated with one or more apertures disposed in a two dimensional array of rows and columns for each of the one or more electron beams, a conducting layer coated on the surface of the flat insulated plate facing the cathode means and a controlled leakage resistance connected to the conducting layer.

2. An electron source as claimed in claim 1 wherein the cathode means includes an extractor grid means and the electron source further comprises the controlled leakage resistance connected to the extractor grid means.

3. An electron source as claimed in claim 1 further comprising a voltage measuring device connected to the conducting layer.

4. An electron source as claimed in claim 1, wherein the cathode means comprises a thermionic emission device.

5. An electron source as claimed in claim 1, wherein the collimation block comprises a magnet.

6. An electron source as claimed in claim 1 incorporated in a display device including a screen for receiving electrons from the electron source, the screen having a phosphor coating facing the side of the collimation block remote from the cathode means; and means for supplying control signals to the control grid and anode means to selectively control flow of electrons from the cathode means to the phosphor coating via the channels thereby to produce an image on the screen.

* * * * *